US007844211B2

(12) United States Patent
Cornwell

(10) Patent No.: US 7,844,211 B2
(45) Date of Patent: Nov. 30, 2010

(54) IONIZING COMMUNICATION DISRUPTOR UNIT

(75) Inventor: James Cornwell, Santa Anna, CA (US)

(73) Assignee: Kaonetics Technologies, Inc., Inyokern, CA (US)

( * ) Notice: Subject to any disclaimer, the term of this patent is extended or adjusted under 35 U.S.C. 154(b) by 302 days.

(21) Appl. No.: 11/792,136

(22) PCT Filed: Nov. 30, 2005

(86) PCT No.: PCT/US2005/043304

§ 371 (c)(1),
(2), (4) Date: Jun. 16, 2008

(87) PCT Pub. No.: WO2006/060471

PCT Pub. Date: Jun. 8, 2006

(65) Prior Publication Data

US 2008/0254737 A1 Oct. 16, 2008

Related U.S. Application Data

(60) Provisional application No. 60/631,981, filed on Dec. 1, 2004.

(51) Int. Cl.
*H04K 3/00* (2006.01)
*H01Q 9/04* (2006.01)

(52) U.S. Cl. ..... 455/1; 455/66.1; 455/127.1; 455/343.1

(58) Field of Classification Search ..... 455/1, 455/19, 24, 66.1, 82, 101, 126, 277.1, 279.1, 455/276.1, 344, 343.1, 127.1; 343/701, 767
See application file for complete search history.

(56) References Cited

U.S. PATENT DOCUMENTS

| | | | | |
|---|---|---|---|---|
| 4,103,218 | A * | 7/1978 | Chevalier et al. | 323/217 |
| 5,594,456 | A * | 1/1997 | Norris et al. | 343/701 |
| 6,377,436 | B1 | 4/2002 | Margolin | |
| 2004/0201942 | A1 * | 10/2004 | Staines et al. | 361/130 |
| 2005/0249667 | A1 * | 11/2005 | Tuszynski et al. | 424/9.3 |

* cited by examiner

*Primary Examiner*—John Lee
(74) *Attorney, Agent, or Firm*—Stroock & Stroock & Lavan LLP

(57) ABSTRACT

An apparatus includes a voltage generator and a superstructure. The voltage generator includes a conductive base, an insulating spacer and a conductive top. The superstructure includes a platform and an antenna system. The voltage generator provides a voltage difference between the conductive base and the conductive top that is greater than 10,000 volts.

57 Claims, 2 Drawing Sheets

IONIZING COMMUNICATION DISRUPTOR UNIT

This application claims the benefit of the filing date of U.S. Provisional Application Ser. No. 60/631,981 filed Dec. 1, 2004 which is incorporated by reference herein.

BACKGROUND OF THE INVENTION

1. Field of the Invention

The present invention relates to communication disruption systems. In particular, the invention relates to ionization generation to disrupt communications over a broad bandwidth.

2. Description of Related Art

Known countermeasure systems have diverse broadband radio signal generators that are fed into a relatively simple antenna. The antenna attempts to have omni-directional coverage. The simplest antenna is a half dipole oriented vertically at the center of the area to be protected by jamming. Such antennas do not have spherical coverage patterns for truly omni coverage. Coverage of such a simple antenna appears shaped like a donut with gaps in coverage above and below the plane of the donut because the simple dipole cannot operate as both an end fire antenna and an omni antenna. More complex antennas may add coverage in end fire directions but generate interference patterns that leave gaps in coverage.

In an environment where small improvised explosive devices (IED) are placed in airplanes, busses or trains and triggered by radio links distant from the IED, it becomes more important to successfully jam the radio link without gaps in jamming system coverage.

SUMMARY OF THE INVENTION

An apparatus includes a voltage generator and a superstructure. The voltage generator includes a conductive base, an insulating spacer and a conductive top. The superstructure includes a platform and an antenna system. The voltage generator provides a voltage difference between the conductive base and the conductive top that is greater than 10,000 volts.

BRIEF DESCRIPTION OF DRAWINGS

The invention will be described in detail in the following description of preferred embodiments with reference to the following figures.

DETAILED DESCRIPTION OF PREFERRED EMBODIMENTS

Figure 1:
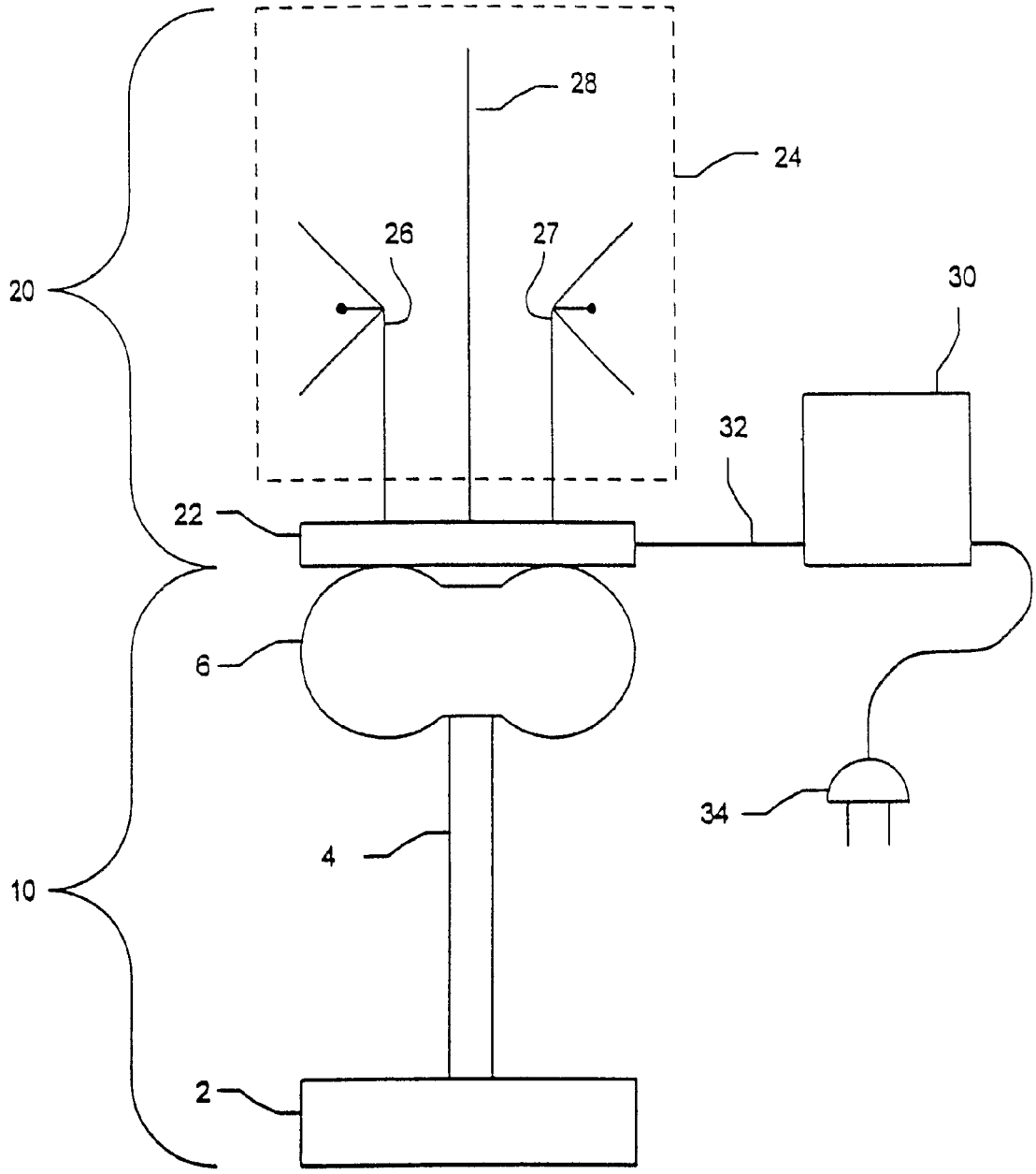
FIG. 1 is a schematic block diagram of an ionizing communications disrupter according to an embodiment of the invention.

In an embodiment of the invention, an apparatus includes a voltage generator 10 and a superstructure 20. The voltage generator 10 includes a conductive base 2, an insulating spacer 4 and a conductive top 6. The superstructure 20 that includes a platform 22 and an antenna system 24. The voltage generator provides a voltage difference between the conductive base and the conductive top that is greater than 10,000 volts.

In the prototype model, the voltage generator, called a suppression tower, was implemented with a Tesla circuit purchased from Research Electronics Technology. The suppression tower stood about 30 inches tall and the conductive top 6 was made of spun aluminum and shaped like a tire having a diameter of about 28 inches. Within the insulating spacer 4 were circuit boards having all necessary inductive and capacitive elements, pulse drives and other elements to implement a Tesla circuit that generates about 400,000 volts between the conductive top 6 and the conductive base 2. The base includes a power supply, either plugged into a power source or a battery or equivalent source.

In a first variant of the embodiment, the antenna system includes plural antennas, each antenna includes at least one elongate element that has a point, and the elongate element is characterized by length that is at least 10 times longer than a diameter of the point.

Broadband antennas are sometimes spoken of in terms of a slenderness ratio defined as the ratio of the length to diameter of the antenna element (e.g., a vertical half-dipole such as a whip antenna). Antennas with larger effective diameter to length ratios will perform over a broader bandwidth when compared to more slender antenna elements. As a result of this principal, designs have been developed to achieve broadband effects, for example, such as folded dipoles, bowtie dipoles and cage dipoles where the effective diameter is increased.

In the present apparatus, designs use this slenderness ratio for an entirely different purpose. Electric fields develop between conductive base 2 and conductive top 6. By placing antennas on platform 22 that have antenna elements with a large slenderness ratio, the fields become concentrated near the end of the antenna element, which is called here, the point.

This feature facilitates the ionic breakdown of the environment near the point. Each point serves as a separate ionic noise generator. In the prototype, the 400,000 volt suppression tower generated sufficient ionization at the antenna points to cause disruption of communications over a very broad spectrum to a distance of 50 or more meters from the suppression tower. Smaller, less costly suppression towers are available to provide 100,000 volts and 10,000 volts. Either of these voltage differences provide sufficient electric field concentration to ionize the atmosphere if the points of the antenna elements are sufficiently sharp (i.e., have a sufficient slenderness ratio). However, at lower voltages, the ability to cause disruption of communications over a very broad spectrum is available only at shorter distances from the suppression tower when compared to a 400,000 volt suppression tower.

Furthermore, forms of high voltage generation need not be restricted to Tesla circuits. Even a Van de Graff generator could provide sufficient voltage; however, it would also have to generate sufficient current at the design voltage to sustain the ionization at the points of the antenna elements. Van de Graph generators are not known for generation of current at high voltages, but any voltage generator capable of sufficient current to sustain the generation of ionization at the points of the antenna elements is a suitable generator.

In an alternative to the first variant of the embodiment, a first antenna includes at least one antenna element formed out of a dielectric material. At high voltages, dielectric materials tend to focus the electric field to be within the dielectric material, to sort of "guide" the electric field, in the same way that conductors would carry electric currents. A dielectric antenna element will cause ionization at the antenna element's point just the same as would be done with electrically conductive materials such as aluminum. Examples of such dielectric materials include either delron or polyvinyl chloride.

In another alternative to the first variant of the embodiment, a first antenna includes at least one antenna element that includes either gold or platinum. The points of the antenna element may suffer electro-erosion effects, and may need to be periodically replaced or maintained. To resist oxidation that may accompany electro-erosion effects, the antenna elements, or at least the points at the ends of the elements, may be formed out of gold or platinum. Often, gold leaf or plating may be sufficient at the points to extend the life of the antenna element. Platinum points may be plated on the points of the antenna elements. Gold or platinum end caps may be affixed to the ends of the antenna elements. In fact, gold or platinum end caps may be adhered to the ends of the antenna elements with adhesive that this not electrical conductive. So long as electric fields span the adhesive gap, ionization takes place in the gold or platinum points and not in the adhesive.

In a second variant of the embodiment, the antenna system includes plural antennas, and a first antenna includes at least one antenna element formed out of a dielectric material. In an alternative to the second variant of the embodiment, the dielectric material includes either delron or polyvinyl chloride or both.

In a third variant of the embodiment, the antenna system includes plural antennas, and a first antenna includes at least one antenna element formed out of either gold or platinum or both.

In a fourth variant of the embodiment, the apparatus further includes jamming circuitry 30 and at least one feed cable 32. Referring to FIG. 2, the jamming circuitry includes a generator 36, an antenna unit 40, and a programmable feed unit 38 coupled between the antenna unit and the generator. The antenna system includes a transmit antenna 26 and a receive antenna 28. The platform 22 (FIG. 1) includes a transmit feed line 56 coupled between the feed cable 32 (FIG. 1) and the transmit antenna 26 and a receive feed line 58 coupled between the feed cable 32 and the receive antenna 28. Note that FIG. 1 depicts an additional antenna 27 to represent multiple additional antennas and antenna pairs as might be used in the jamming circuitry discussed below to selectively jam several particular communications bands.

Figure 2:
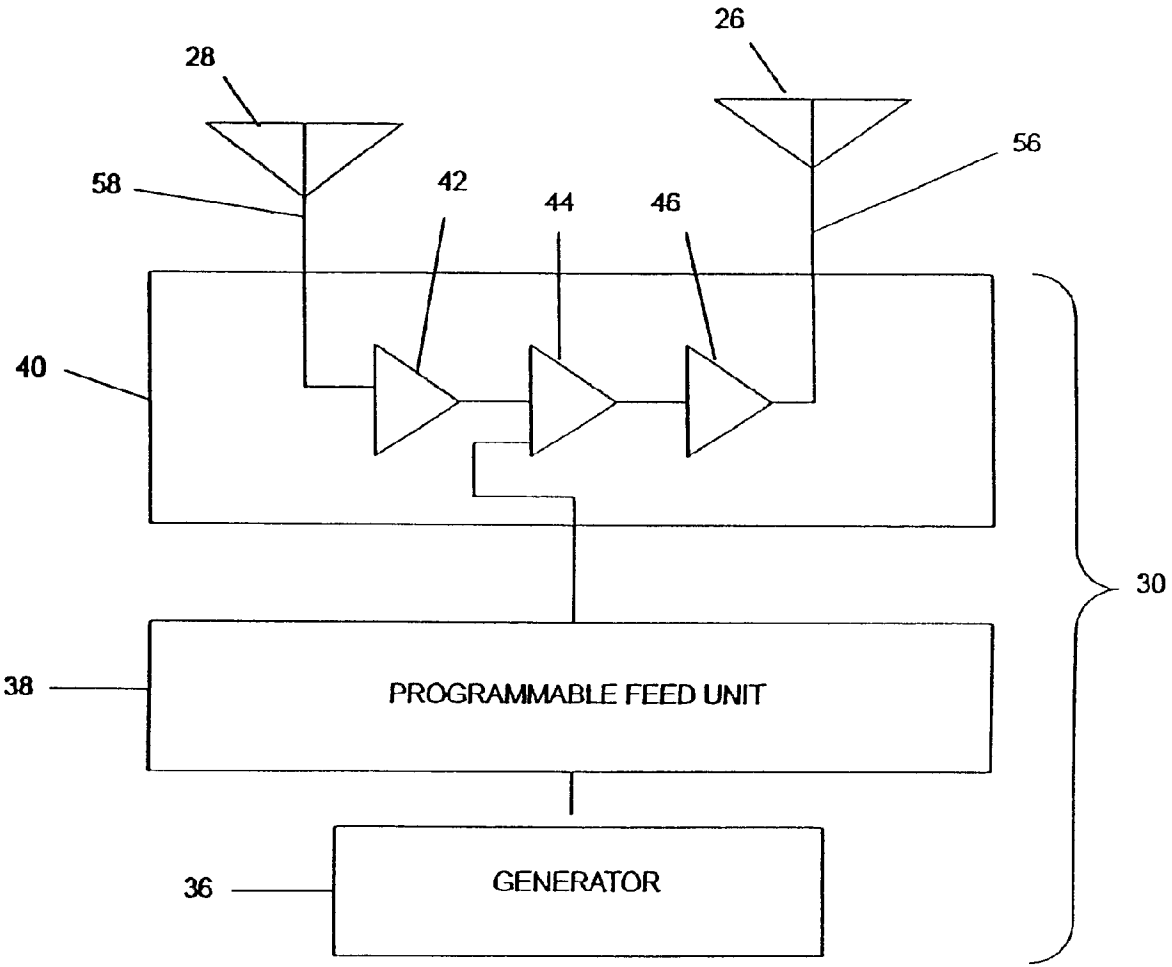
FIG. 2 is a schematic block diagram of jamming circuitry as may be used in the ionizing communications disrupter of FIG. 1.

An example of the fourth variant of the embodiment of the invention depicted in FIGS. 1, 2 is where a system includes a generator 36 and jamming circuitry 30. The jamming circuitry 30 includes a receive antenna 28, a transmit antenna 26, an antenna unit 40 and a programmable feed unit 38 coupled between antenna unit 40 and generator 36. A signal received at the receive antenna 28 is amplified and broadcasted from the transmit antenna 26 so that the device itself oscillates and produces a random noise signal.

In a first alternative to the fourth variant of the embodiment, the antenna unit 40 includes a receiver 42 coupled to the receive antenna 28, an amplifier 44 coupled to the receiver 42 and coupled (in this exemplary case coupled through programmable feed unit 38) to the generator 36, and a transmitter 46 coupled between the amplifier 44 and the transmit antenna 26. A signal from generator 36 is provided to the programmable feed unit 38, and the signal includes:

1. a noisy signal from generator 36 to the programmable feed unit 38;

2. a signal to control phase shifting of the noisy signal in the programmable feed unit; and 3. a signal to control attenuation of the noisy signal in the programmable feed unit.

The programmable feed unit 38 may includes either a programmable attenuator coupled to the generator, a programmable phase shifter coupled to the generator, or both. The phase shifted and/or attenuated version of the noisy signal is then provided by the programmable feed unit 38 to control the controllable amplifier 44 in the receiver unit. This ensures random noise is produced from the transmit antenna 26.

In a second alternative to the fourth variant of the embodiment, the programmable feed unit 38 includes a programmable attenuator coupled to the generator 36. In an example of the second alternative to the fourth variant of the embodiment, the antenna unit 40 includes a receiver 42 coupled to the receive antenna 28, an amplifier 44 coupled to the receiver and coupled (in this exemplary case coupled through programmable feed unit 38) to the generator 36, and a transmitter 46 coupled between the amplifier 44 and the transmit antenna 26. In a case where the programmable feed unit 38 includes the programmable attenuator, the programmable attenuator may include a variable gain amplifier characterized by a gain controlled by a signal from the generator.

In a third alternative to the fourth variant of the embodiment, the programmable feed unit 38 includes a programmable phase shifter coupled to the generator. The programmable feed unit 38 may includes either a programmable attenuator coupled to the generator, a programmable phase shifter coupled to the generator, or both. In a case where the programmable feed unit 38 includes the programmable phase shifter, the programmable phase shifter may be mechanized with several designs.

In one design, the programmable phase shifter includes a network that includes a variable inductor where an inductance of the inductor is controlled by a signal from the generator. An example of such a variable inductor is a saturable inductor. A saturable inductor includes two coils wound around a common magnetic material such as a ferrite core. Through one coil, a bias current passes to bring the ferrite core in and out of saturation. The other coil is the inductor whose inductance is varied according to the bias current. The bias current is generated in generator 36, and it may be either a fix bias to set the phase shifting property or it may be a pulsed waveform to vary the phase shifting property.

In another design, the programmable phase shifter includes a network that includes a variable capacitor where a capacitance of the capacitor is controlled by a signal from the generator. A back biased varactor diode is an example of such a variable capacitor.

In yet another design, the programmable phase shifter includes a variable delay line where a delay of the delay line is controlled by a signal from the generator. A typical example of this type of delay line at microwave frequencies is a strip line disposed between blocks of ferrite material where the blocks of ferrite material are encircled by coils carrying a bias current so that the ferrite materials are subjected to a magnetizing force. In this way, the propagation properties of strip line are varied according to the magnetizing force imposed by the current through the coil.

In yet another design, the programmable phase shifter includes two or more delay lines, each characterized by a different delay. The phase shifter further includes a switch to select an active delay line, from among the two or more delay lines, according to a signal from the generator.

Whatever the design that is used, the bias current or control signal is generated in generator 36. It may be either a fix voltage or current to set the phase shifting property of the programmable feed unit or it may be a pulsed waveform to vary the phase shifting property.

In an example of the third alternative to the fourth variant of the embodiment, the antenna unit 40 includes a receiver 42 coupled to the receive antenna 28, an amplifier 44 coupled to the receiver 42 and coupled (in this exemplary case coupled through programmable feed unit 38) to the generator 36, and a transmitter 46 coupled between the amplifier 44 and the transmit antenna 26.

In operation, the system tends to oscillate on its own. A signal from the transmit antenna 26 is picked up on the receive antenna 28. The signal picked up on the receive antenna 28 is received in receiver 42, amplified in amplifier 44 and provided to transmitter 46 that is coupled the transmit antenna 26. When this loop provides enough gain, the system will oscillate on its own. In fact, the proximity of the antennas pretty much ensures that the loop will always have enough gain. Amplifier 44 may well provide fractional amplification or operate as an attenuator. This loop is adjusted to have a loop gain sufficient to just oscillate on its own. The receive antenna 28 may pick up additional signals from other nearby transmit antennas in the system and from reflections off nearby reflective surfaces. In addition, signals from the programmable feed device 38 as discussed herein, are added into the loop at amplifier 44. The loop gain is adjusted to oscillate with a random noisy waveform in this environment.

In another variant of the embodiment, generator 36 is processor controlled. The processor may be a microprocessor or other processor. A memory stores the modes of operations in the form of a threat table that specifies such parameters as the center frequency and the bandwidth of the signals to be generated by generator 36 for each threat or application (e.g., tunnel, aircraft, railroad car, office auditorium, etc.) and stores the attenuation and phase shifting properties to be provided to the programmable feed units 38. In a typical generator design, the threat table provides a center frequency for a radio frequency jamming signal and also provides a seed for a random number generator (e.g., digital key stream generator). The random numbers are used to generate a randomly chopped binary output waveform, at about 5 to 20 times the center frequency, that is used as a chopping signal to modulate the signal at the center frequency. Many other types of noise generators may also be used. The output of the chopped center frequency signal is a broadband noise signal that is provided to the programmable feed unit 38.

In alternative variants, generator 36 includes circuits to generate additional randomly chopped binary output waveforms, according to parameters in the threat table, to control the variable attenuator and/or the variable phase shifter in the programmable feed unit 38. Alternatively, the threat table may store a fixed number, for each threat, to provide a fixed attenuation and a fixed phase shift in the programmable feed unit 38 that may be selected differently for each threat.

In another variant of the embodiment, either the transmit antenna or the receive antenna, or both, are directional antennas directed toward a reflective surface. In operation, directing antenna gain toward a reflective surface tends to create reflections picked up by the receive antenna to add to the randomness of the system to aid in disruption of communication signals within a range of the system to achieve the desired level of jamming inside the area to be protected. In another variant, the system is located near a reflective surface or reflective surfaces that are characterized by a curvature or multiple facets. The reflective surface includes any or all of the inside walls of an aircraft, the inside walls of a railroad car, the inside walls of bus, the walls of a subway tunnel, the walls of an automobile tunnel, the superstructure of a bridge and the walls of an auditorium, conference room, studio or the like. This produces reflected signals that appear to come from conjugate images of the transmit antennas of the devices.

In another variant of the first embodiment, the generator produces a signal that is characterized by a center frequency and a band spread. The generator includes a comb generator with a bandwidth greater than 20% of the center frequency and preferably greater than 50% of the center frequency. In practical systems, jamming of signals at frequencies of 312, 314, 316, 392, 398, 430, 433, 434 and 450 to 500 MHz may be desired. A center frequency of 400 MHz and a jamming bandwidth of 200 MHz (307 MHz to 507 MHz, a 50% bandwidth) would cover this range. A very suitable system for some applications may be realized by jamming 430 through 500 MHz (a 20% bandwidth centered on 460 MHz). The frequency band from 312 through 316 MHz may be easily covered by a 2% bandwidth generator, and the 392 and 398 MHz frequencies may be easily covered by a generator with just a little more than 2% bandwidth.

Multiple jamming circuits 30, plus associated antennas, may be employed to jam multiple communications channels, as required.

In typical operation, the jamming circuitry is not operated at the same time as the ionizing apparatus is operated. The antennas of the jamming apparatus have the points that generate the ionization. These points, and the antennas they are attached to, operate at a very high voltage with respect to the base 2 (FIG. 1) which is connected to a local ground. Therefore, jamming circuitry 30 includes a rechargeable battery for its operation. When the ionizing apparatus is not in operation, plug 34 of the jamming circuitry is plugged into a local power source to charge its internal batteries. Then, the plug 34 is disconnected from the power source and insulated from ground with sufficient insulation to resist either arcing or a drain on the supply of high voltage used by the ionizing apparatus. Then, the ionizing apparatus can be turned on and operated. Preferably, the ionizing apparatus also has rechargeable batteries that can be charged before the apparatus is disconnected from the power grid. The ionizing apparatus has advantages of providing extremely broad band jamming, whereas, the jamming circuitry, or several such jamming circuits, can be provided in the same apparatus to jam selected communication channels.

Having described preferred embodiments of a novel ionizing communication disrupter unit (which are intended to be illustrative and not limiting), it is noted that modifications and variations can be made by persons skilled in the art in light of the above teachings. It is therefore to be understood that changes may be made in the particular embodiments of the invention disclosed which are within the scope of the invention as defined by the appended claims.

Having thus described the invention with the details and particularity required by the patent laws, what is claimed and desired protected by Letters Patent is set forth in the appended claims.

What is claimed is:

1. An apparatus comprising:

a voltage generator that includes a conductive base, an insulating spacer and a conductive top; and a superstructure that includes a platform and an antenna system, the antenna system includes plural antennas;

each antenna includes at least one elongate element that has a point; and the elongate element is characterized by length that is at least 10 times longer than a diameter of the point, wherein the voltage generator provides a voltage difference between the conductive base and the conductive top that is greater than 10,000 volts.

2. An apparatus according to claim 1, wherein a first antenna includes at least one antenna element formed out of a dielectric material.

3. An apparatus according to claim 2, wherein the dielectric material includes at least one of delron and polyvinyl chloride.

4. An apparatus according to claim 2, wherein:

the first antenna includes at least one antenna element formed out of a plurality of dielectric materials.

5. An apparatus according to claim 4, wherein the dielectric material includes delron.

6. An apparatus according to claim 5, wherein the first antenna includes at least one antenna element formed out of at least one of gold and platinum.

7. An apparatus according to claim 1, wherein a first antenna includes at least one antenna element formed out of at least one of gold and platinum.

8. An apparatus according to claim 1, further comprising jamming circuitry.

9. An apparatus according to claim 8 wherein the jamming circuitry further includes a signal generator, and the antenna system includes a transmit antenna and a receive antenna.

10. An apparatus according to claim 9 further comprising an antenna unit, wherein the antenna unit includes a receiver coupled to one of the plurality of antennas, an amplifier coupled to the receiver and coupled to the signal generator, and a transmitter coupled between the amplifier and another of the plurality of antennas.

11. The apparatus according to claim 10 wherein the jamming circuitry further includes a programmable feed unit which permits an operator to select the frequency bands to be jammed by the jamming circuitry, the programmable feed unit coupled between the antenna unit and the signal generator.

12. An apparatus according to claim 8 further comprising an antenna unit, wherein the antenna unit includes a receiver coupled to one of the plurality of antennas, an amplifier coupled to the receiver, and a transmitter coupled between the amplifier and another of the plurality of antennas.

13. An apparatus according to claim 8 wherein the jamming circuitry further includes a programmable feed unit which permits an operator to select the frequency bands to be jammed by the jamming circuitry.

14. The apparatus according to claim 8 wherein the programmable feed unit includes at least one of a programmable attenuator coupled to the generator; and a programmable phase shifter coupled to the generator.

15. The apparatus according to claim 8 wherein the jamming circuitry is configured to operate separately and at different times than the ionizing mode of operation when at least one of the antennas creates ionic breakdown of the atmosphere.

16. The apparatus according to claim 15 wherein the plurality of antennas includes a transmit antenna and a receive antenna and the at least one antenna for creating the ionic breakdown of the atmosphere is at least one of the transmit antenna and receive antenna.

17. An apparatus comprising:

a voltage generator that includes a conductive base, an insulating spacer and a conductive top; and a superstructure that includes a platform and an antenna system, and the antenna element has a first end connected to the voltage generator, a second end extending away from the first end and in communication with the atmosphere, and a length that is at least ten (10) times longer than a diameter of the second end, wherein the voltage generator provides a voltage difference between the conductive base and the conductive top that is greater than 100,000 volts.

18. An apparatus according to claim 17, wherein the voltage generator provides a voltage difference between the conductive base and the conductive top that is greater than 400,000 volts.

19. The apparatus of claim 18 wherein the antenna system comprises at least one antenna element formed of dielectric material.

20. The apparatus of claim 19 wherein the antenna element is formed of a plurality of dielectric elements.

21. The apparatus of claim 20 wherein the plurality of dielectric elements are formed of different dielectric materials having different dielectric constants.

22. The apparatus of claim 20 wherein the system includes a plurality of antennas.

23. The apparatus of claim 22 wherein at least one antenna has an antenna element formed of a plurality of dielectric materials having different dielectric constants.

24. The apparatus of claim 20 wherein the dielectric element includes at least one of the group of delron and polyvinyl chloride.

25. The apparatus of claim 20 further comprising jamming circuitry that produces a radio frequency signal that is feed to the antenna element.

26. The apparatus of claim 17 wherein the antenna system comprises at least one antenna element formed of dielectric material.

27. The apparatus of claim 26 wherein the antenna element is formed out of a plurality of dielectric materials having different dielectric constants.

28. The apparatus of claim 26 wherein the antenna element has a point.

29. The apparatus of claim 26 further comprising jamming circuitry that produces a radio frequency signal that is feed to the antenna element.

30. The apparatus of claim 29 wherein the antenna system includes a plurality of antennas, at least one antenna has an antenna element formed of a plurality of dielectric materials having different dielectric constants.

31. The apparatus of claim 17 wherein the antenna system includes plural antennas, at least one antenna having an antenna element formed out of dielectric material.

32. An apparatus comprising:

a voltage generator that includes a conductive base, an insulating spacer and a conductive top; and a superstructure that includes a platform and an antenna system, wherein the voltage generator provides a voltage difference between the conductive base and the conductive top that is greater than 10,000 volts, and further comprising jamming circuitry and at least one feed cable, wherein:

the jamming circuitry includes a generator, an antenna unit, and a programmable feed unit coupled between the antenna unit and the generator; and the antenna system includes a transmit antenna and a receive antenna; and the platform includes a transmit feed line coupled between the feed cable and the transmit antenna and a receive feed line coupled between the feed cable and the receive antenna.

33. An apparatus according to claim 32, wherein the antenna unit includes:

a receiver coupled to the receiver antenna;

an amplifier coupled to the receiver and coupled to the generator; and a transmitter coupled between the amplifier and the transmit antenna.

34. An apparatus according to claim 32, wherein the programmable feed unit includes at least one of:

a programmable attenuator coupled to the generator; and a programmable phase shifter coupled to the generator.

35. An apparatus according to claim 34, wherein the antenna unit includes:

a receiver coupled to the receive antenna;

an amplifier coupled to the receiver and coupled to the generator; and a transmitter coupled between the amplifier and the transmit antenna.

36. An apparatus comprising:

a voltage generator that includes a conductive base, an insulating spacer and a conductive top;

a superstructure that includes a platform and an antenna system;

the antenna system comprising at least one antenna element formed of dielectric material; and jamming circuitry that produces a radio frequency signal that is feed to the antenna element, wherein the voltage generator provides a voltage difference between the conductive base and the conductive top that is greater than 100,000 volts, and wherein the jamming circuitry does not feed a signal to the antenna element at the same time that the voltage generator feeds a voltage discharge to the antenna element.

37. The apparatus of claim 36 wherein the antenna element has a first end connected to the voltage generator, a second end extending away from the first end and in communication with the atmosphere, and a length that is at least ten (10) times longer than a diameter of the second end.

38. A communications disruptor system comprising:

a voltage generator that includes a conductive base and a conductive top which provides a voltage difference between the conductive base and the conductive top of about 10,000 volts or greater;

an antenna system including an antenna element formed of a plurality of dielectric elements; and a feed connected between the antenna element and voltage generator to feed voltage supplied by the voltage generator to the antenna element wherein the dielectric elements are configured and arranged to focus the electric field to cause ionization of the atmosphere.

39. The communications disruptor system of claim 38 wherein the antenna has a first end connected to the feed and a second end extending away from the first end and in communication with the atmosphere, wherein the dielectric elements are configured and arranged to concentrate and focus the electric field at the second end of the antenna.

40. The communications disruptor system of claim 38 wherein the plurality of dielectric elements include different dielectric materials with different dielectric constants.

41. The communications disruptor system of claim 38 wherein at least one of the dielectric elements is delron.

42. The communications disruptor system of claim 38 wherein the antenna system comprises plural antennas.

43. The communications disruptor system of claim 38 wherein the voltage generator provides a voltage difference between the conductive base and the conductive top that is greater than 100,000 volts.

44. The communications disruptor system of claim 43 wherein the plurality of dielectric elements include different dielectric materials having different dielectric constants.

45. The communications disruptor system of claim 43 wherein at least one of dielectric elements is delron.

46. The communications disruptor system of claim 43 wherein the antenna system comprises a plurality of antennas.

47. The communications disruptor system of claim 46 wherein the plurality of dielectric elements include different dielectric materials having different dielectric constants.

48. The communications disruptor system of claim 47 further comprising jamming circuitry that produces a radio frequency signal that is feed to the antenna element.

49. The communications disruptor system of claim 43 further comprising jamming circuitry that produces a radio frequency signal that is feed to the antenna element.

50. The communications disruptor system of claim 38 further comprising jamming circuitry that produces a radio frequency signal that is feed to the antenna element.

51. The communications disruptor system of claim 38 wherein the antenna element has a point.

52. The communications disruptor system of claim 38 wherein the antenna has a first end connected to the feed, a second end in communication with the atmosphere and a length that is at least ten (10) times longer than a diameter of the second end.

53. The communications disruptor system of claim 38 further comprising jamming circuitry, the jamming circuitry including a signal generator, a receive antenna and a transmit antenna, wherein the signal generator, receive antenna and transmit antenna are configured to oscillate and emit a signal from the transmit antenna to interfere with radio frequency communications.

54. The communications disruptor system of claim 53 further comprising antenna unit circuitry including a receiver coupled to the receive antenna, an amplifier coupled to the receiver and the signal generator, and a transmitter coupled between the amplifier and the transmit antenna.

55. The communications disruptor system of claim 38 further comprising jamming circuitry including a signal generator that is processor controlled to produce the desired signal frequency to be feed to the antenna element.

56. The communications disruptor system of claim 38 further comprising jamming circuitry including a signal generator, wherein the jamming circuitry does not feed a signal to the antenna element at the same time that the voltage generator feeds a voltage discharge to the same antenna element.

57. The communications disruptor system of claim 56 wherein the signal frequency generated by the signal generator is feed to the antenna element and the voltage discharge generated by the voltage generator is feed to the same antenna element.

* * * * *